US011330894B2

(12) United States Patent
Rushing

(10) Patent No.: US 11,330,894 B2
(45) Date of Patent: May 17, 2022

(54) COMBINED BACKPACK AND BODY ARMOR CARRIER

(71) Applicant: David Rushing, Norcross, GA (US)

(72) Inventor: David Rushing, Norcross, GA (US)

( * ) Notice: Subject to any disclaimer, the term of this patent is extended or adjusted under 35 U.S.C. 154(b) by 230 days.

(21) Appl. No.: 16/442,588

(22) Filed: Jun. 17, 2019

(65) Prior Publication Data

US 2019/0380478 A1 Dec. 19, 2019

Related U.S. Application Data

(60) Provisional application No. 62/686,428, filed on Jun. 18, 2018.

(51) Int. Cl.

| | |
|---|---|
| ***A45F 4/02*** | (2006.01) |
| ***F41H 1/02*** | (2006.01) |
| ***F41H 5/08*** | (2006.01) |
| ***F41H 5/013*** | (2006.01) |
| ***A45F 3/06*** | (2006.01) |
| *A45F 3/04* | (2006.01) |

(52) U.S. Cl.

CPC ..... *A45F 4/02* (2013.01); *A45F 3/06* (2013.01); *F41H 1/02* (2013.01); *F41H 5/013* (2013.01); *F41H 5/08* (2013.01); *A45F 2003/045* (2013.01)

(58) Field of Classification Search

CPC ..... A45F 4/02; A45F 3/06; A45F 2003/045; F41H 1/02; F41H 5/013; F41H 5/08

See application file for complete search history.

(56) References Cited

U.S. PATENT DOCUMENTS

| | | | | | |
|---|---|---|---|---|---|
| 4,830,245 | A * | 5/1989 | Arakaki | A45F 3/04 | 2/2.5 |
| 5,031,733 | A * | 7/1991 | Chang | A41D 15/04 | 190/1 |
| 5,060,314 | A * | 10/1991 | Lewis | F41H 1/02 | 2/2.5 |
| 5,617,582 | A * | 4/1997 | Burwell | A41D 13/0012 | 2/102 |
| 5,644,792 | A * | 7/1997 | Tishler | F41H 1/02 | 2/2.5 |
| 6,161,738 | A * | 12/2000 | Norris | A45C 9/00 | 109/49.5 |
| 6,419,132 | B1 * | 7/2002 | Reed | A45C 15/00 | 109/49.5 |

(Continued)

*Primary Examiner* — Brian D Nash

(74) *Attorney, Agent, or Firm* — Asgaard Patent Services, LLC; F. Wayne Thompson, Jr.

(57) ABSTRACT

Implementations of a backpack that can be converted into a protective vest are provided. In a first configuration, the backpack may be used to store and transport items. When confronted with an imminent threat (e.g., an active shooter), the backpack can be converted to a second configuration that serves as a protective vest configured to provide ballistic protection for the wearer's chest and back (i.e., body armor). The backpack does not need to be removed from the wearer's torso when being converted to the protective vest configuration. The protective vest contains at least one ballistic armor insert in both the front and rear panel sections thereof. The backpack includes a container that is detachable therefrom. This detachable container may include an internal pocket that contains at least one ballistic armor insert and enarme that allow the detachable container to be used as a shield.

7 Claims, 8 Drawing Sheets

(56) References Cited

U.S. PATENT DOCUMENTS

| | | | | |
|---|---|---|---|---|
| 6,685,071 | B2 * | 2/2004 | Prather | A45C 15/00 2/2.5 |
| 7,441,278 | B2 | 10/2008 | Blakeley | |
| 8,181,834 | B1 * | 5/2012 | Howell | A45F 3/06 224/630 |
| 9,003,947 | B1 * | 4/2015 | Rittenhouse, Jr. | F41H 1/02 89/36.05 |
| 9,572,414 | B1 * | 2/2017 | Mitchell | A45F 4/02 |
| 9,737,100 | B2 * | 8/2017 | McIntire, Jr. | F41H 1/02 |
| 9,820,558 | B1 | 11/2017 | de Geus | |
| 10,098,441 | B1 * | 10/2018 | Holloman | A45C 9/00 |
| 10,130,160 | B1 * | 11/2018 | Cheng | A45F 3/06 |
| 10,306,971 | B2 * | 6/2019 | Zhang | F41H 5/08 |
| 10,986,911 | B2 * | 4/2021 | Cotirla | A45F 4/02 |
| 11,026,501 | B1 * | 6/2021 | Dabrowka | A45F 3/06 |
| 2008/0277433 | A1 * | 11/2008 | Karl | A45F 3/20 224/148.6 |
| 2009/0127299 | A1 * | 5/2009 | Jamlang | A45F 3/14 224/153 |
| 2009/0206115 | A1 * | 8/2009 | Gleason | A45F 3/04 224/153 |
| 2011/0113520 | A1 * | 5/2011 | Dennis | F41H 1/02 2/2.5 |
| 2013/0327803 | A1 * | 12/2013 | Chiang | A45F 3/14 224/582 |
| 2015/0196077 | A1 | 7/2015 | McIntire, Jr. | |
| 2016/0033235 | A1 * | 2/2016 | Kinnings | F41H 1/02 2/102 |
| 2017/0102214 | A1 * | 4/2017 | Wright | F41H 5/013 |
| 2017/0276457 | A1 | 9/2017 | Chapman | |
| 2017/0318941 | A1 | 11/2017 | Vaughan et al. | |
| 2018/0317635 | A1 * | 11/2018 | Quon-Chow | A45F 4/02 |
| 2019/0038007 | A1 * | 2/2019 | Swan | A45F 3/06 |
| 2019/0154405 | A1 * | 5/2019 | Burnau | F41H 5/08 |
| 2019/0174903 | A1 * | 6/2019 | Holder | F41H 5/08 |
| 2020/0217622 | A1 * | 7/2020 | James | A45F 3/04 |
| 2021/0000246 | A1 * | 1/2021 | Alson | A45F 3/06 |

* cited by examiner

COMBINED BACKPACK AND BODY ARMOR CARRIER

CROSS REFERENCE TO RELATED APPLICATION

This application claims the benefit of U.S. Provisional Application Ser. No. 62/686,428, which was filed on Jun. 18, 2018, the entirety of which is incorporated herein by reference.

TECHNICAL FIELD

This disclosure relates to implementations of a combined backpack and body armor carrier. In particular, the present invention is directed to a backpack configured to be converted into a protective vest. In some implementations, the backpack may include a detachable container configured for use as a ballistic shield.

BACKGROUND

Modern body armor, such as ballistic vests and ballistic plate carrier systems, are designed to absorb the impact and stop (or reduce) the penetration of projectiles fired by a firearm. While body armor was historically used to protect military personal, it is now used by police, security guards and private citizens.

Ballistic vests are made of layers of woven or laminated fibers (e.g., poly-paraphenylene terephthalamide), and rated to protect the wearer from specified handgun and shotgun projectiles. Some ballistic vests can be augmented with one or more ballistic plate inserts. Ballistic plate carrier systems typically hold one or more removable ballistic plate inserts that may be used in conjunction with soft armor backers. In this way, while the ballistic plate carrier system is being worn, a ballistic plate insert is positioned over, at least, the chest and back of the wearer.

Unfortunately, modern body armor is also heavy, bulky, and difficult to transport when not being worn. As such, civilians rarely choose to purchase body armor for their own safety because it is impractical for them to wear and/or carry the body armor on a regular basis. As a result, these individuals are left unprotected if caught in an active shooter incident.

In recent years, the number of active shooter incidents has increased throughout the United States and other parts of the world. Most active shooters use firearms and select their victims at random. The majority of active shooter incidents occur at locations, often referred to as "soft targets" (e.g., schools, stadiums, etc.), that have limited security measures to protect members of the public. Civilians, and off duty members of the military and police, caught in these situations often have no way to protect themselves.

In view of the forgoing, there is a need to provide individuals with a convenient way to transport and deploy a protective vest that can be used during an active shooter incident, or other dangerous situation.

Accordingly, it can be seen that needs exist for the combined backpack and body armor carrier disclosed herein. It is to the provision of a combined backpack and body armor carrier configured to address these needs, and others, that the present invention is primarily directed.

SUMMARY OF THE INVENTION

Implementations of a combined backpack and body armor carrier are provided. In a first configuration, the backpack may be used to store and transport items. When confronted with an imminent threat (e.g., an active shooter), the backpack can be converted to a second configuration that serves as a protective vest configured to provide ballistic protection for the wearer's chest and back (i.e., body armor). The backpack does not need to be removed from the wearer's torso when being converted to the protective vest configuration. The protective vest is configured to contain at least one ballistic armor insert in both the front and rear panel sections thereof. The backpack includes a container that is detachable therefrom. This detachable container may be configured to contain at least one ballistic armor insert and for use as a ballistic shield.

In some implementations, the backpack comprises a pair of shoulder straps, a central compartment that conceals the front and rear panel sections of the protective vest, and a detachable container constructed and arranged to store and transport items. The front and rear panel sections each include an internal pocket configured to receive at least one ballistic armor insert. The central compartment is disposed between the detachable container and a back panel of the backpack. The pair of shoulder straps and the front panel section of the protective vest are secured to the back panel of the backpack. When converting the backpack into the protective vest configuration, the detachable container can be completely separated from the backpack. This exposes the front and rear panel sections of the protective vest and allows the rear panel section to be positioned over the back of the wearer.

In some implementations, the detachable container comprises an internal pocket configured to receive at least one ballistic armor insert, and enarme that allow the detachable container to be used as a shield.

BRIEF DESCRIPTION OF THE DRAWINGS

Like reference numerals refer to corresponding parts throughout the several views of the drawings.

DETAILED DESCRIPTION

Figure 1:
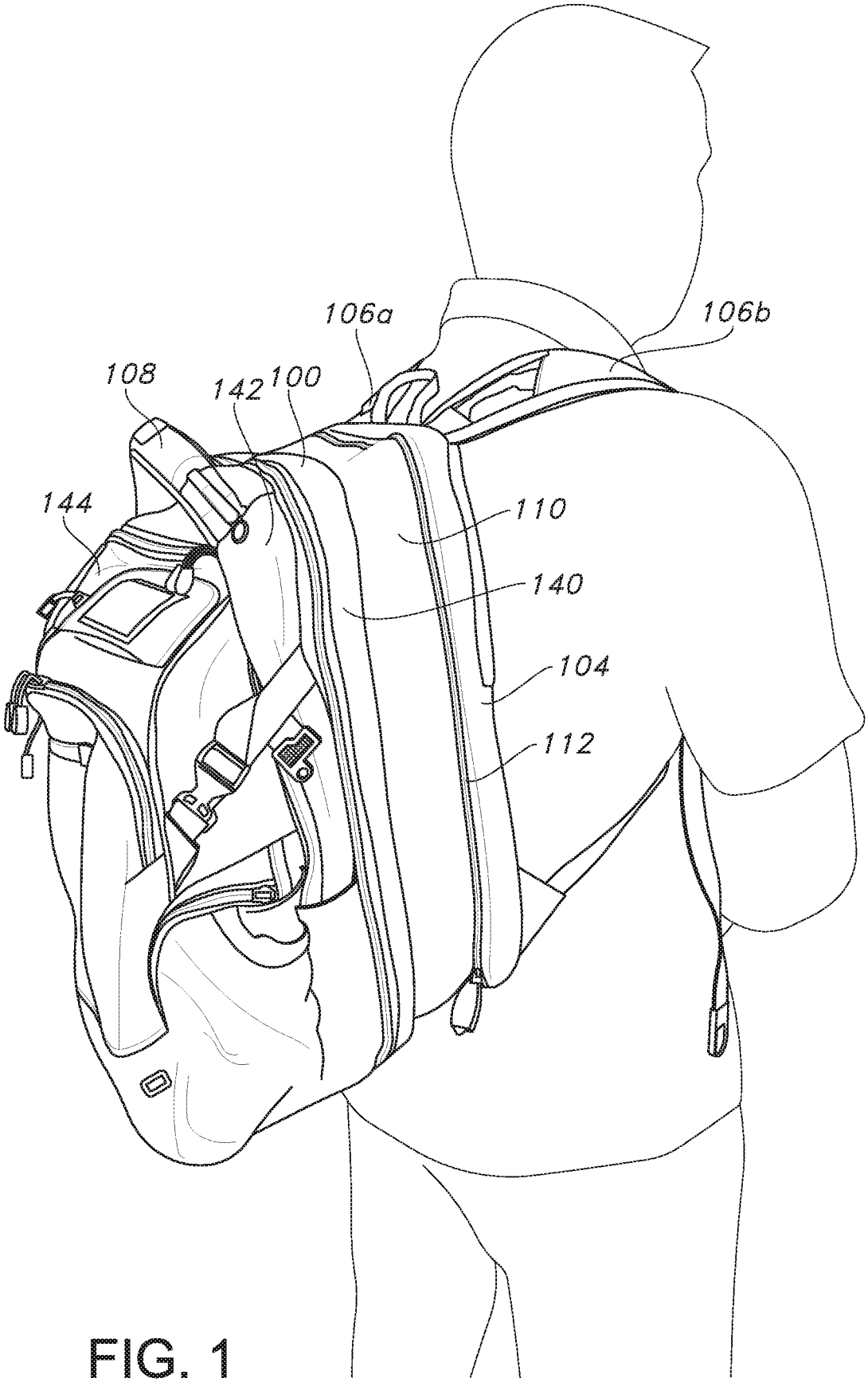
FIG. 1 illustrates an isometric view of an individual wearing an example of the present invention, in its backpack configuration, on their back in accordance with the principles of the present disclosure.

FIGS. 1-6 illustrate an example implementation of a combined backpack and body armor carrier, designated as numeral 100, made in accordance with the principles of the present disclosure. In a first configuration, the backpack 100 may be used to store and transport items (see, e.g., FIGS. 1 and 2). When confronted with an imminent threat (e.g., an active shooter), the backpack 100 can be converted to a second configuration that serves as a protective vest (i.e., body armor) configured to provide ballistic protection for the wearer's chest and back (see, e.g., FIGS. 3-5). The backpack 100 does not need to be removed from the wearer's torso when being converted into the protective vest configuration. The protective vest is configured to contain rigid ballistic plates and/or flexible ballistic inserts in both the front and rear panel sections 120, 130 thereof. The backpack 100 includes a container 140 that is detachable therefrom (see, e.g., FIG. 3). In some implementations, this container 140 may be configured to contain a rigid ballistic plate and/or a flexible ballistic insert and for use as a ballistic shield (see, e.g., FIG. 6).

As shown in FIGS. 1-6, in some implementations, the backpack 100 may comprise a pair of shoulder straps (106*a*, 106*b*), a central compartment 110 that conceals the front and rear panel sections 120, 130 of the protective vest, and a detachable container 140 constructed and arranged to store and transport items. In some implementations, the backpack 100 may also include a carry handle 108.

As shown in FIG. 1, in some implementations, the shoulder straps 106*a*, 106*b* permit a wearer to carry the backpack 100, along with any items stored therein, on their back. In some implementations, the shoulder straps 106*a*, 106*b* may be padded. When a wearer senses danger, the backpack 100 may be converted into a protective vest by shifting the backpack 100 from the wearer's back (see, e.g., FIG. 1) to where the back-facing portion thereof rest on the wearer's front side (or chest) (see, e.g., FIG. 2). It should be understood that, while configured as a protective vest, the shoulder straps 106*a*, 106*b* of the backpack 100 stay situated on the wearer's shoulders.

Figure 2:
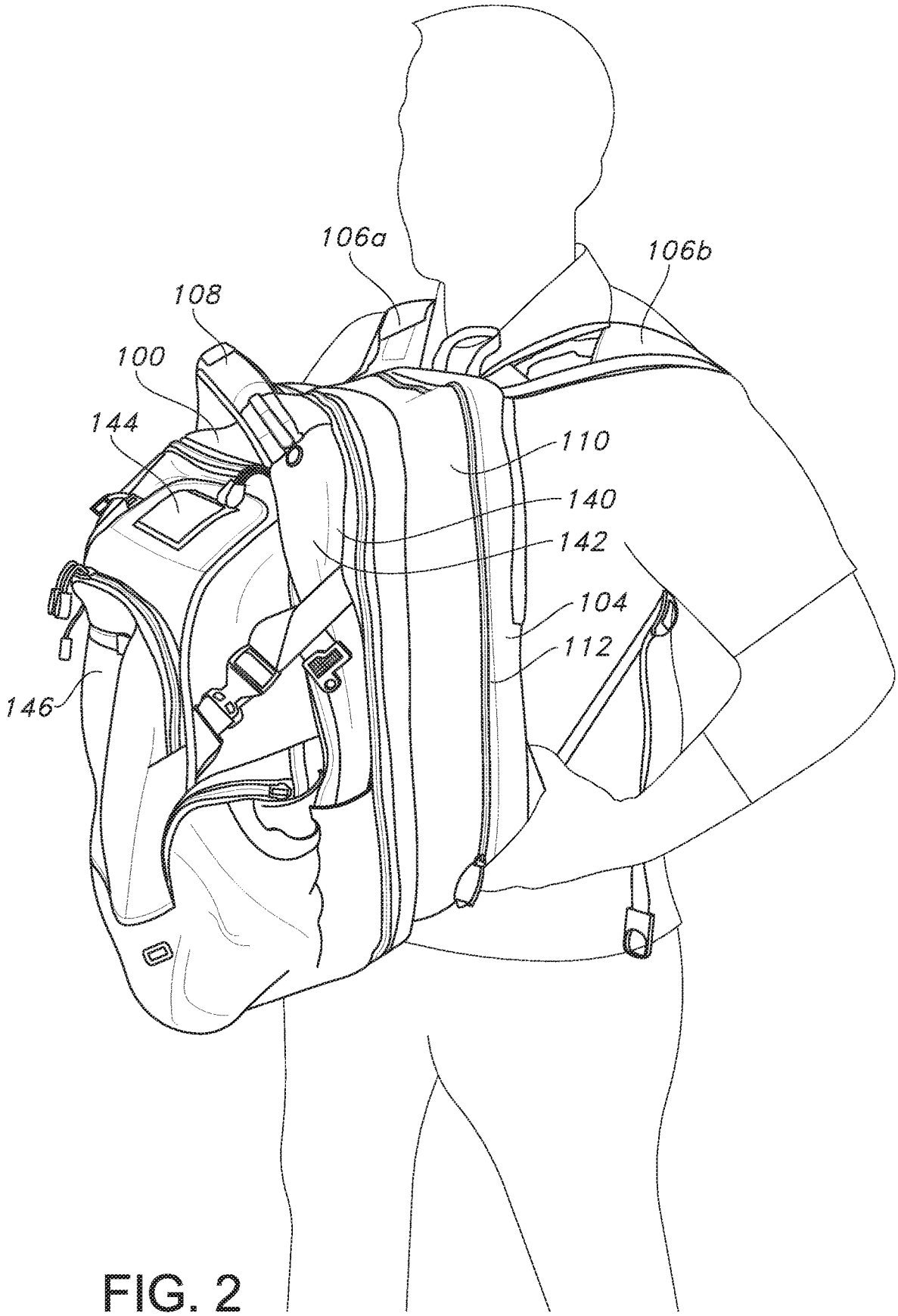
FIG. 2 illustrates an isometric view of an individual wearing an example of the present invention, in its backpack configuration, on their chest in accordance with the principles of the present disclosure.

As shown in FIGS. 1 and 2, in some implementations, the central compartment 100 is disposed between the detachable container 140 and a back panel 104 of the backpack 100. In some implementations, the shoulder straps 106 and the front panel section 120 of the protective vest are secured to the back panel 104 of the backpack 100.

Figure 3:
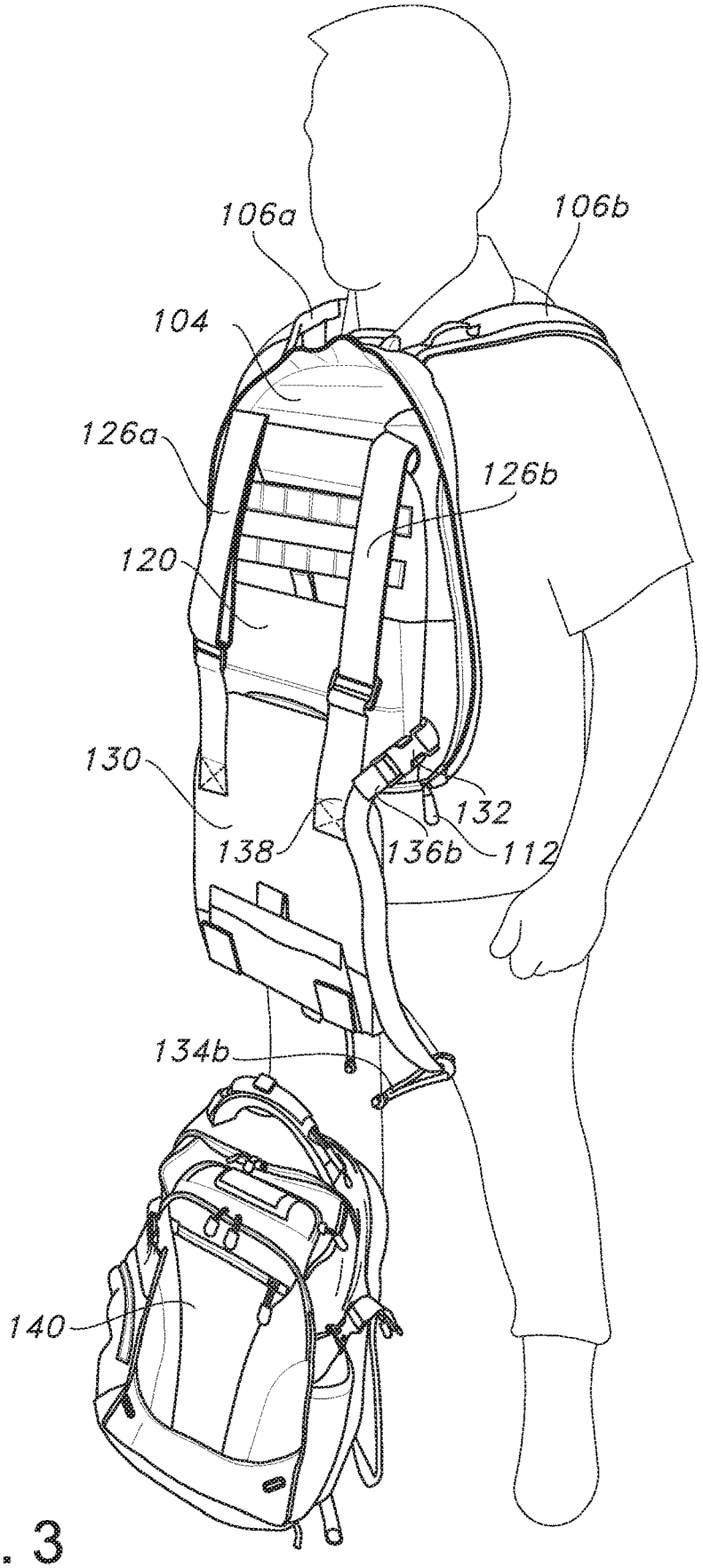
FIG. 3 illustrate an isometric view of an individual wearing the protective vest portion of the present invention, and the detachable container that was separated therefrom, in accordance with the principles of the present disclosure.

As shown in FIGS. 1 and 3, in some implementations, a fastener 112 provides access to the central compartment 110 and enables the backpack 100 to separate into two portions, namely, the protective vest and the detachable container 140. In this implementation, the fastener 112 is a zipper. However, any suitable fastener may be utilized to connect the two portions of the backpack 100 (e.g., hook-and-loop fasteners, snap connectors, etc.). Once the detachable container 140 has been separated from the backpack 100, the rear panel section 130 of the protective vest may be positioned on the wearer's back (see, e.g., FIG. 4).

As shown in FIG. 3, in some implementations, the front and rear panels sections 120, 130 of the backpack 100 are connected together by a pair of straps 126*a*, 126*b* that extend therebetween. When configured as a protective vest, the straps 126*a*, 126*b* connecting the front and rear panel sections 120, 130 of the protective vest are situated on the wearer's shoulders and may overlap the shoulder straps 106*a*, 106*b* of the backpack 100 (see, e.g., FIG. 4).

Figure 4:
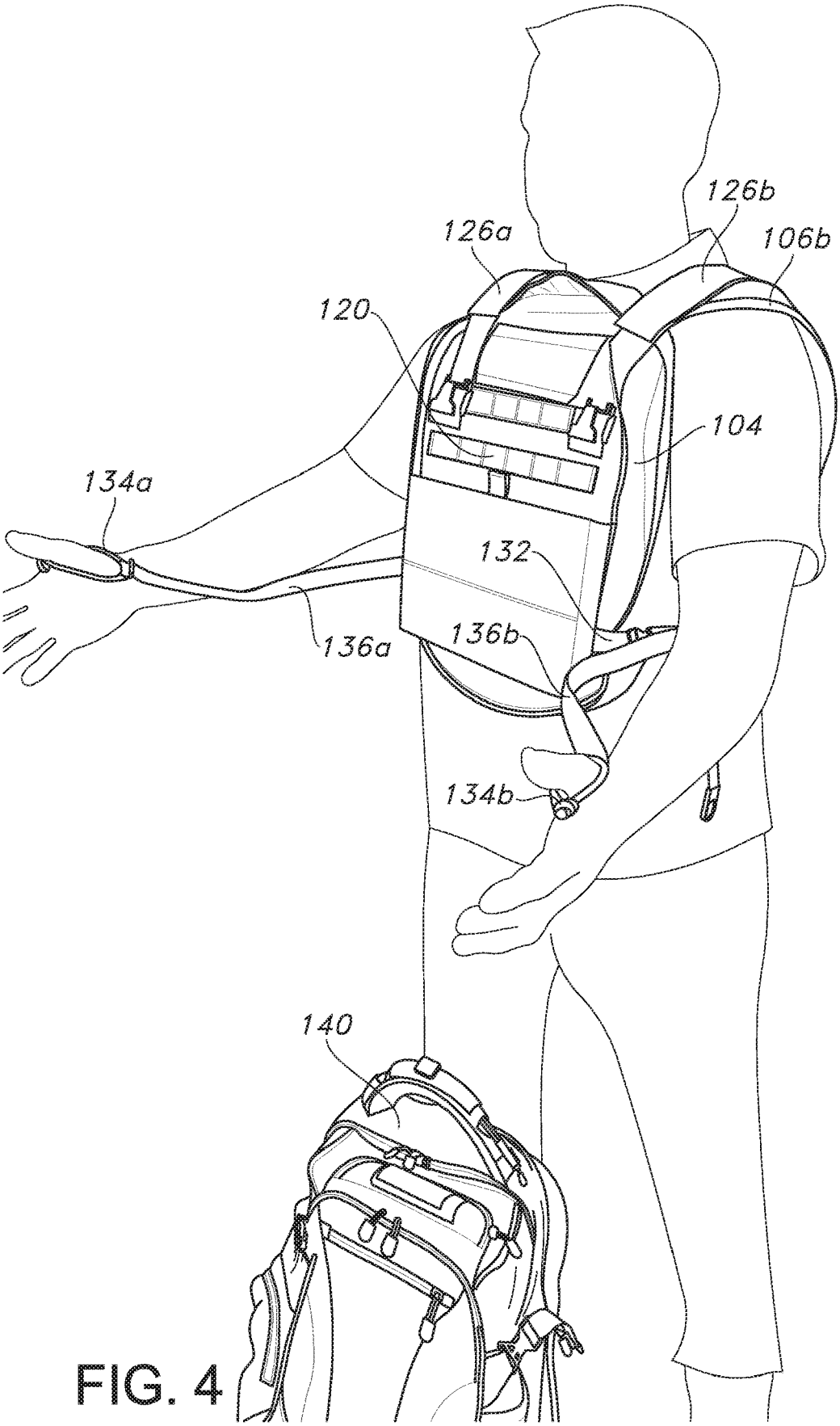
FIG. 4 illustrates an isometric view of an individual tightening the lower straps of the protective vest in accordance with the principles of the present disclosure, thereby securing the front and rear panels of the protective vest in position over their chest and back, respectively.
Figure 5:
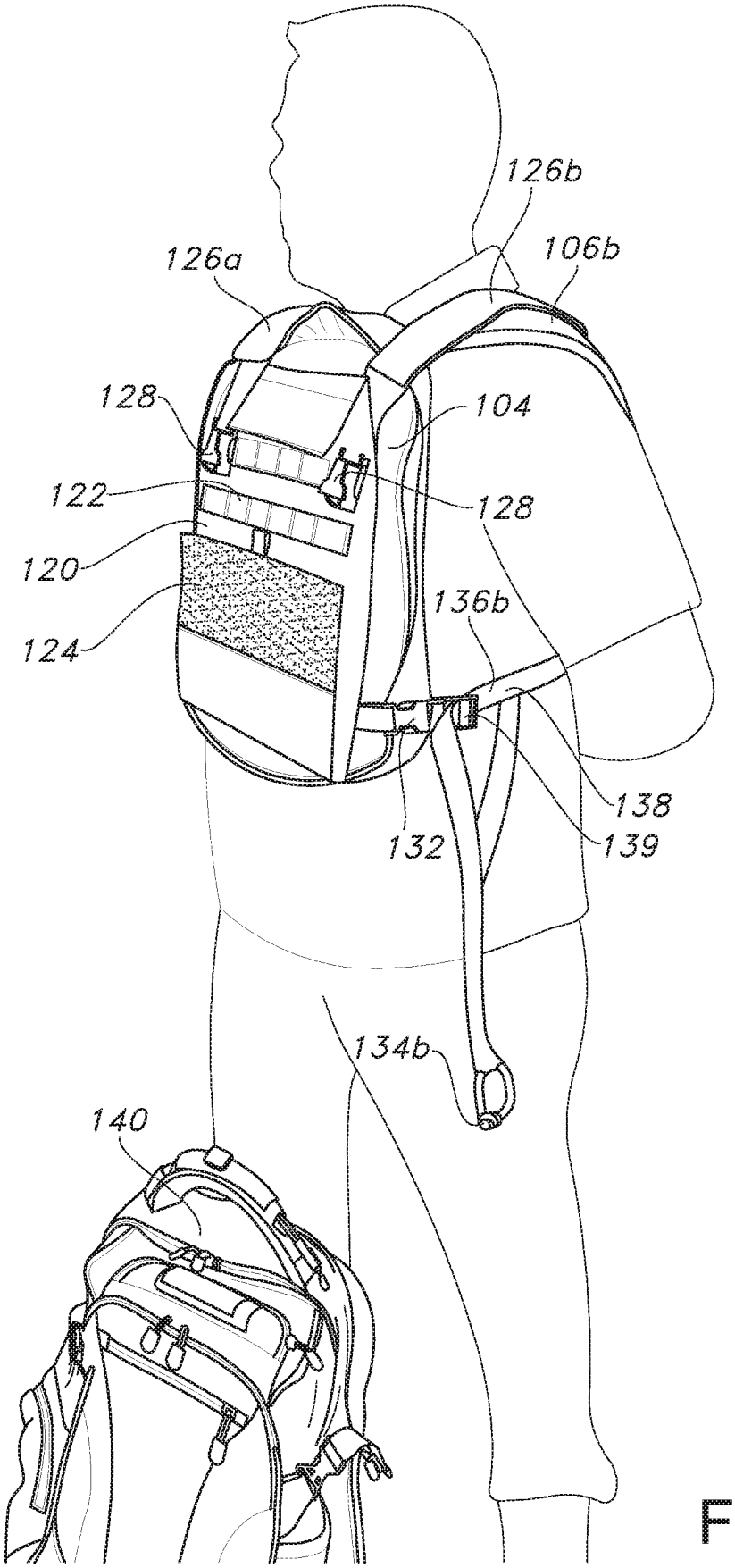
FIG. 5 illustrates an isometric view of an individual wearing the protective vest in accordance with the principles of the present disclosure.
Figure 6:
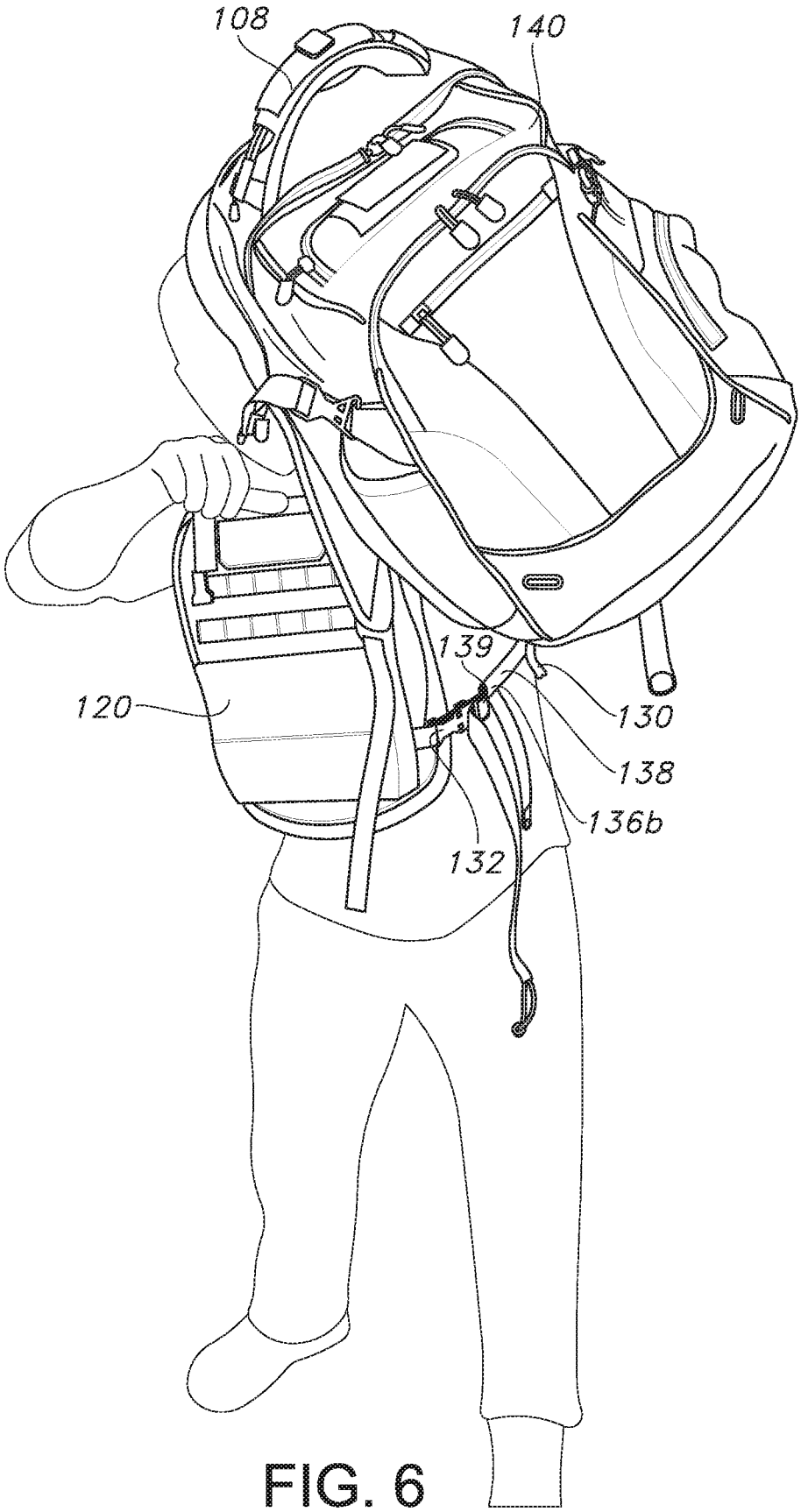
FIG. 6 illustrates an isometric view of the individual shown in FIG. 5 using the detachable container as a ballistic shield in accordance with the principles of the present disclosure.

As shown in FIGS. 4 and 5, in some implementations, the protective vest of the backpack 100 further comprises adjustable lower straps 136*a*, 136*b* configured to snugly position the front and rear panel sections 120, 130 against the wearer's body. In some implementations, a first end of each lower strap 136*a*, 136*b* is secured to an edge of the rear panel section 130, near the bottom edge thereof. Each of the lower straps 136*a*, 136*b* form a defined loop 138 that is configured to be disposed along a side of the wearer's lower torso and is attached by a buckle 132 to an edge of the front panel section 130, near the bottom edge thereof (see, e.g., FIG. 5). In some implementations, each of the lower straps 136*a*, 136*b* includes a tri-glide buckle 139 configured for adjusting the size of the defined loop 138 formed thereby. In some implementations, the distal end of each lower strap 136*a*, 136*b* may include a ring 134*a*, 134*b* thereon.

As shown in FIG. 5, when the rear panel section 130 of the protective vest has been positioned on the wearer's back, the defined loops 138 formed by the adjustable lower straps 136*a*, 136*b* are positioned between the wearer's arms and body. In some implementations, pulling on the ring 134*a*, 134*b* secured to the distal end of each lower strap 136*a*, 136*b* tightens them around the sides of the wearer's lower body. In this way, the front and rear panels section 120, 130 of the protective vest may be secured in position on the chest and back, respectively, of the wearer. It should be understood that pulling the rings 134*a*, 134*b* in a downward direction pulls each of the lower straps 136*a*, 136*b* through their respective tri-glide 139 which reduces the size of each defined loop 138, thereby tightening the lower straps 136*a*, 136*b* along the sides of the wearer's lower body.

In some implementations, the front panel section 120 and the rear panel section 130 of the backpack 100 each include an internal pocket configured to receive at least one ballistic armor insert therein (e.g., a ballistic plate, a flexible ballistic insert, or a combination thereof). In this way, the front and rear panel sections can be used to provide ballistic protection for the thoracic region of the wearer. A ballistic armor insert may be a rigid ballistic plate (e.g., steel, ceramic, or plastic resin composite plate) or a flexible ballistic insert (e.g., Kevlar® inserts), both of which are well known in the prior art and will not be described in detail herein.

As shown in FIG. 5, in some implementations, the front panel section 120 and the rear panel section 130 of the protective vest may include PALS webbing 122, hook-and-loop fastener portion(s) 124, and buckles 128, on an exterior surface thereof, configured to facilitate the attachment of gear (e.g., magazine pouches, a medical kit, a holster, a tactical chest rig, etc.).

Although not shown, in some implementations, the backpack 100 may further comprise a groin protector that depends from a bottom edge of the front panel section 120. The groin protector may be secured to the bottom edge of the front panel section 120 by hook-and-loop fasteners, snap connectors, or any other suitable fastener(s) known to those of ordinary skill in the art. In some implementations, the groin protector provides ballistic protection for the abdomen and groin area of the wearer. In some implementations, the groin protector may be configured to serve as a container (or pouch) for a rigid ballistic plate, a flexible ballistic insert, or a combination thereof.

Figure 7:
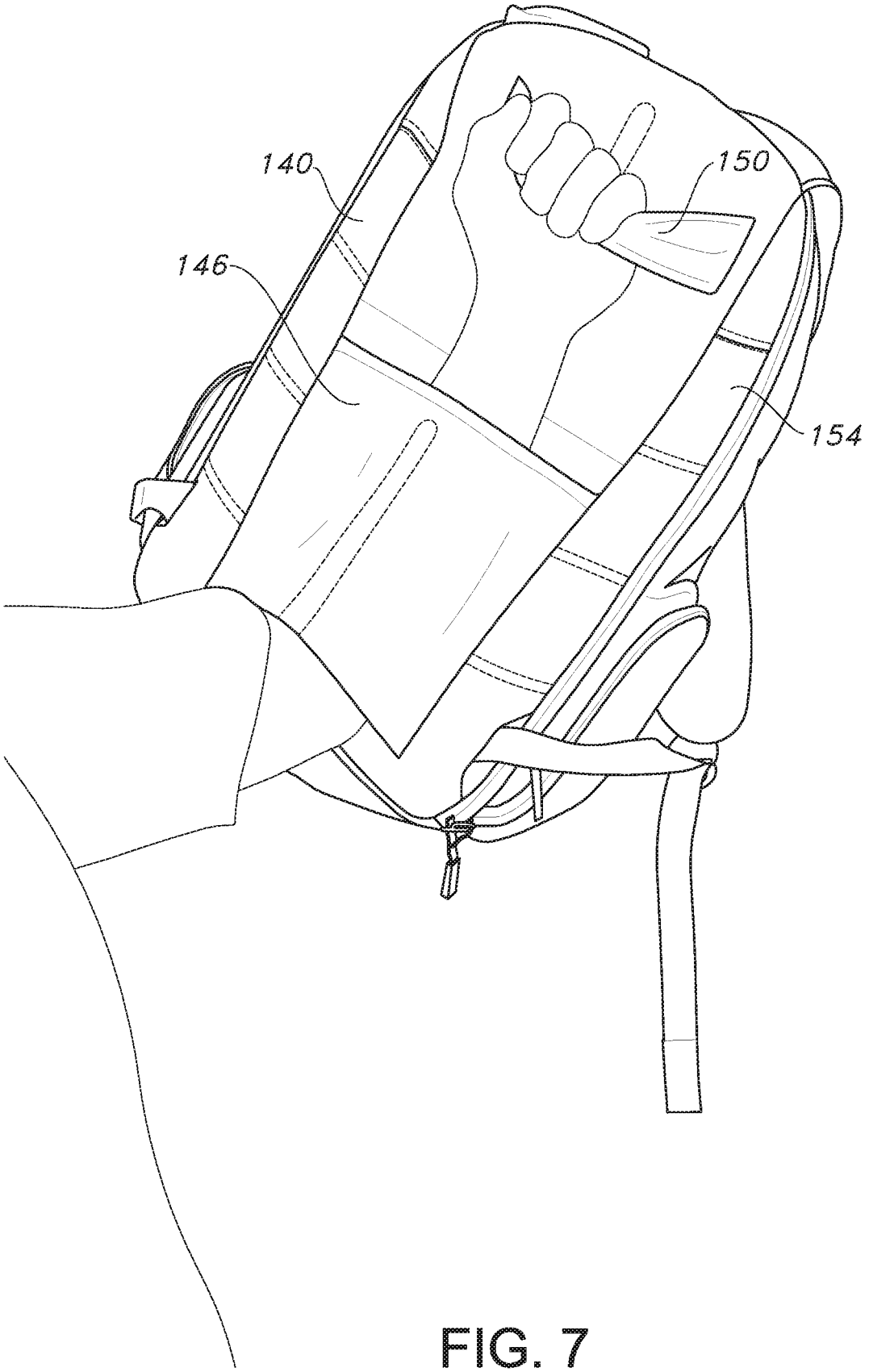
FIG. 7 illustrates an individual using the enarme to don the detachable container as a ballistic shield in accordance with the principles of the present disclosure.

As shown in FIG. 7, in some implementations, the detachable container 140 may include a pair of enarme 146, 150 secured to a backside thereof. In some implementations, the first enarme 146 is configured to fit about the forearm of the wearer and the second enarme 150 is configured to be grasped by the wearer's hand. In this way, the detachable container 140 may be secured to the arm of a wearer and used as a shield (see, e.g., FIG. 6).

In some implementations, the detachable container 140 may be transported using the carry handle 108.

In some implementations, the detachable container 140 may include several storage compartments (e.g., 142, 144, 146) for holding items selected by the wearer. The storage compartments may include any number of pockets or receptacles that are constructed and arranged for accommodating various items. In some implementations, the storage compartments (e.g., 142, 144, 146) of the detachable container 140 can be sealed and unsealed with corresponding fasteners. In this implementation, the fasteners are zippers. However, any suitable fastener (e.g., hook-and-loop fasteners, snap connectors, etc.) may be utilized to seal and unseal a storage compartment of the detachable container 140.

Figure 8:
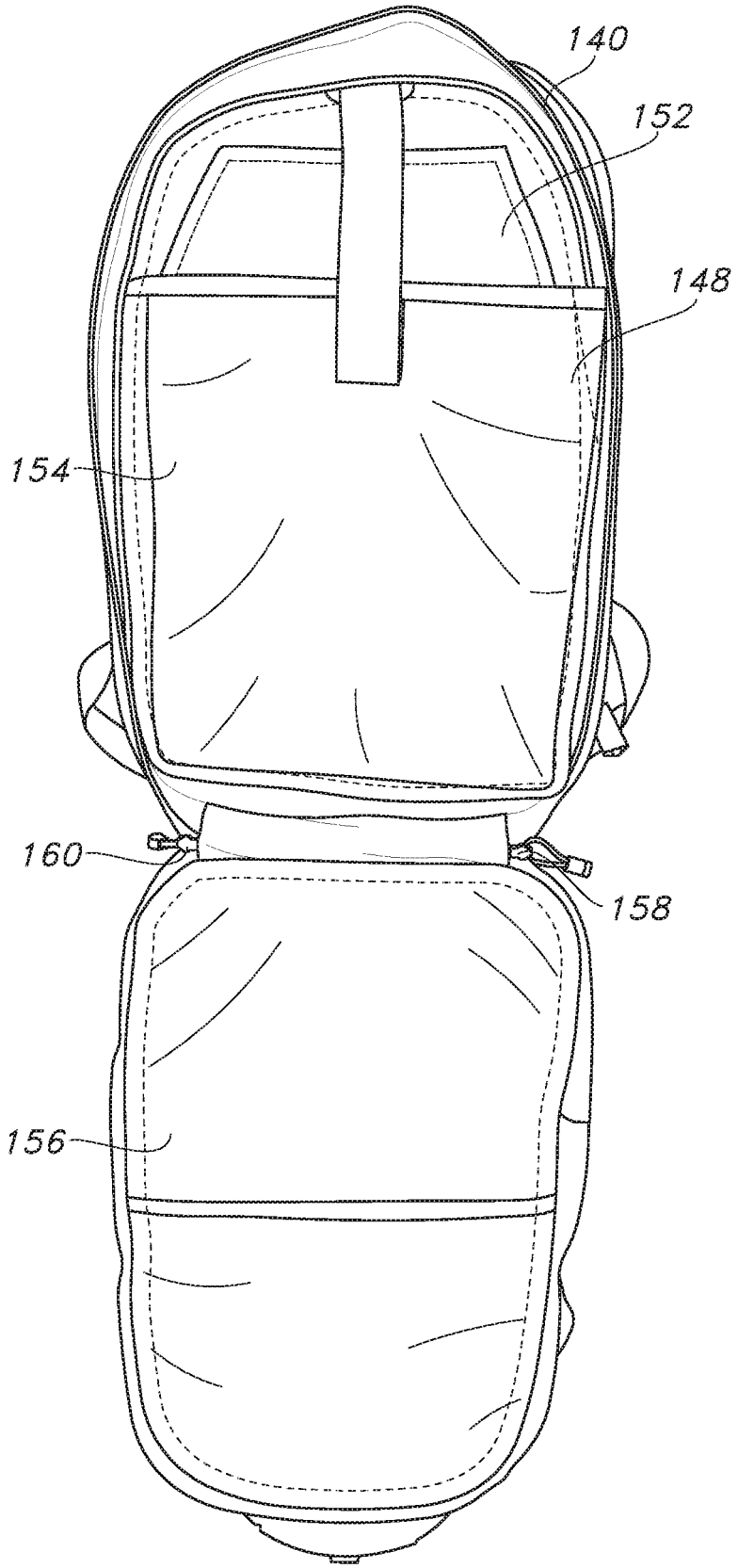
FIG. 8 illustrates an example detachable container constructed in accordance with the principles of the present disclosure.

As shown in FIG. 8, in some implementations, the detachable container 140 of the backpack 100 includes at least one internal pocket 148 configured to receive at least one ballistic armor insert 152 therein. In this way, the detachable container 140 can be used as a ballistic shield. A ballistic armor insert may be a conventional rigid ballistic plate (e.g., steel, ceramic, or plastic resin composite plate) or a flexible ballistic insert (e.g., Kevlar® insert), both of which are well known in the prior art and will not be described in detail herein.

As shown in FIG. 8, in some implementations, the detachable container 140 has a clam-shell construction and comprises first and second shell parts 154, 156 hinged together so that they can be opened and closed. Complimentary fasteners 158, 160 (e.g., zippers) may be provided to secure the container 140 closed. In addition to the ballistic armor insert 152 stored in the internal pocket 148 of the first shell part 154, the second shell part 156 may include an internal pocket configured to receive at least one ballistic armor insert (not shown). In this way, when the first and second shell parts 154, 156 are separated, the area of ballistic protection offered by the detachable container 140 is increased.

The various components of the backpack 100 may be assembled using any suitable method known to those of ordinary sill in the art (e.g., stitching). The various portions of the backpack 100 may be made of any suitable material, or combination of materials (e.g., nylon, cotton, polyester, etc.).

The follow steps, as shown in FIGS. 1-6, may be used to convert the combined backpack and body armor carrier 100 from the backpack configuration (or first configuration) shown in FIG. 1 to the protective vest configuration (or second configuration) shown in FIG. 5.

Once the wearer elects to convert the backpack 100 into the protective vest configuration, the wearer removes a first arm from a first shoulder strap (e.g., 106*a*) and rotates the backpack 100 so that the back-facing portion thereof is positioned against their chest. While the backpack 100 is being rotated about the torso, the second arm is removed from a second shoulder strap (e.g., 106*b*) while the first arm is inserted therein. The second arm is then inserted into the first shoulder strap (e.g., 106*a*). In this way, the backpack 100 may be positioned on the wearer's chest (see, e.g., FIG. 2).

Next, the fastener 112 for accessing the central compartment 110 is used to separate the detachable container 140 from the backpack 100 (see, e.g., FIG. 3).

Then, the rear panel section 130 of the protective vest is pulled up and over the wearer's head so that the straps 126*a*, 126*b* connecting it to the front panel section 120 are resting on the wearer's shoulders. While the rear panel portion 130 is being pulled over the wearer's head; the second arm of the wearer may be inserted between the first shoulder strap 126*a* and the first lower strap 136*a*, and the first arm of the wearer may be inserted between the second shoulder strap 126*b* and the second lower strap 136*b* (see, e.g., FIG. 4). In this way, the lower straps 136*a*, 136*b* are positioned between the wearer's arms and body.

Next, the ring 134*a*, 134*b* on the distal end of each lower strap 136*a*, 136*b* is pulled in a downward direction to tighten the lower straps 136*a*, 136*b* around the sides of the wearer's lower torso (see, e.g., FIG. 4).

In this way, the front and rear panel sections 120, 130 of the protective vest are positioned on the chest and back, respectively, of a wearer (see, e.g., FIG. 5).

If the detachable container 140 includes a ballistic armor insert (e.g., insert 152), the user may opt to don it using the provided enarme 146, 150. To don the detachable container 140 as a ballistic shield, the wearer inserts a first hand through an opening defined by the first enarme 146 and grasps the second enarme 150 (see, e.g., FIG. 7).

Alternatively, the wearer may leave the detachable container 140 where it falls or transport it using the provided carry handle 108.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A backpack configured to be converted into a protective vest, the backpack comprising:

a pair of shoulder straps;

a central compartment that conceals a front panel section and a rear panel section of the protective vest, the front panel section and the rear panel section each include an internal pocket configured to receive at least one ballistic armor insert; and a detachable container constructed and arranged to store and transport items;

wherein the central compartment is disposed between the detachable container and a back panel of the backpack;

wherein the pair of shoulder straps and the front panel section of the protective vest are secured to the back panel of the backpack;

wherein, when converting the backpack into the protective vest, the detachable container can be completely separated from the backpack, thereby leaving the front panel section positioned over the chest of a wearer and allowing the rear panel section to be positioned over the back of the wearer.

2. The backpack of claim 1, wherein the detachable container comprises an internal pocket configured to receive at least one ballistic armor insert, and enarme that allow the detachable container to be used as a shield.

3. The backpack of claim 2, wherein a first of the enarme is configured to fit about a forearm of the wearer and a second of the enarme is configured to be grasped by the wearer.

4. A method for converting a backpack into a protective vest, the method comprising:

providing a backpack comprising: a pair of shoulder straps; a central compartment that conceals a front panel section and a rear panel section of the protective vest, the front panel section and the rear panel section each include an internal pocket configured to receive at least one ballistic armor insert; and a detachable container constructed and arranged to store and transport items; wherein the central compartment is disposed between the detachable container and a back panel of the backpack; wherein the pair of shoulder straps and the front panel section of the protective vest are secured to the back panel of the backpack; wherein the front panel section and the rear panel section are connected together by a pair of adjustable lower straps, each lower strap forms a defined loop that is configured to be disposed along a side of the lower torso of a wearer;

positioning a back-facing portion of the backpack against the chest of the wearer while inserting a first arm into a second shoulder strap and a second arm into a first shoulder strap;

completely separating the detachable container from the backpack;

positioning the rear panel section of the protective vest over the back of the wearer such that a pair of straps connecting it to the front panel section come to rest on the shoulders of the wearer;

while the rear panel section is being positioned over the back of the wearer, inserting the second arm between the first shoulder strap and the first lower strap and the first arm between the second shoulder strap and the second lower strap; and pulling a distal end of each lower strap in a downward direction to tighten the lower straps around the lower torso of the wearer.

5. The method of claim 4, wherein the detachable container comprises an internal pocket configured to receive at least one ballistic armor insert, and enarme that allow the detachable container to be used as a shield; the method further comprising donning the detachable container using the enarme thereof.

6. The method of claim 5, the method further comprising inserting a hand through an opening defined by a first enarme and grasping a second enarme.

7. A method of using a backpack that includes a detachable container configured to act as a shield, the method comprising:

providing a backpack comprising a pair of shoulder straps; a central compartment that conceals a front panel section and a rear panel section of a protective vest, the front panel section and the rear panel section each include an internal pocket configured to receive at least one ballistic armor insert; and a detachable container constructed and arranged to store and transport items; wherein the detachable container comprises an internal pocket configured to receive at least one ballistic armor insert, and enarme that allow the detachable container to be used as a shield;

completely separating the detachable container from the backpack;

donning the detachable container by inserting a hand through an opening defined by a first enarme and grasping a second enarme.

* * * * *